US009352816B1

(12) United States Patent
Sawyer, Jr.

(10) Patent No.: US 9,352,816 B1
(45) Date of Patent: May 31, 2016

(54) TOMMY POWER OAR

(71) Applicant: Thomas Kidder Sawyer, Jr., Martinsville, MO (US)

(72) Inventor: Thomas Kidder Sawyer, Jr., Martinsville, MO (US)

( * ) Notice: Subject to any disclaimer, the term of this patent is extended or adjusted under 35 U.S.C. 154(b) by 0 days.

(21) Appl. No.: 14/545,007

(22) Filed: Mar. 16, 2015

(51) Int. Cl.
*B63H 16/04* (2006.01)
*B63H 1/14* (2006.01)
*B63H 5/125* (2006.01)

(52) U.S. Cl.
CPC ..... *B63H 16/04* (2013.01); *B63H 1/14* (2013.01); *B63H 5/125* (2013.01)

(58) Field of Classification Search
CPC ..... B63H 16/04; B63H 1/14; B63H 5/125
USPC ..... 440/53, 101–110
See application file for complete search history.

(56) References Cited

U.S. PATENT DOCUMENTS 1,512,391 A * 10/1924 Abraham ..... B63H 16/04 416/120
1,786,451 A * 12/1930 Ribard ..... B63H 16/04 416/231 A
7,850,497 B2 * 12/2010 Kang ..... B63H 16/04 440/101
8,512,086 B1 * 8/2013 Charczuk ..... B63H 20/007 416/74
2001/0034168 A1 * 10/2001 Williams ..... B63H 1/30 440/96
2009/0261209 A1 * 10/2009 Mioduchevski ..... B64C 39/04 244/7 R
2013/0035010 A1 * 2/2013 Boukas ..... B63H 1/14 440/6
2015/0203184 A1 * 7/2015 Sarmiento ..... B64B 1/24 244/30
2015/0209622 A1 * 7/2015 Guinyard ..... A63B 35/08 440/38

FOREIGN PATENT DOCUMENTS

DE 3817077 A1 * 12/1988 ..... B63H 16/04
FR 828671 A * 5/1938 ..... B63H 16/04
FR 845550 A * 8/1939 ..... B63H 16/04

* cited by examiner

*Primary Examiner* — Joshua Kennedy

(57) ABSTRACT

An oar rowing device that may be configured to accommodate a canoe, rowboat, rowing skull or any similar watercraft using an oar rowing device. This oar rowing device blade is equipped with one or more multi-blade propeller housing each having a multi-blade propeller. Each propeller housing with a multi-blade propeller is open on both sides of the oar rowing blade. This oar rowing blade may also be equipped with cone shaped orifice housings through the oar rowing blade each having a center rotating cone shape with inner ribs and grooves. The pulling stroke of the oar rowing device generates the kinetic energy to put into motion the multi-blade propeller and the inner rotating cone shape orifice device.

6 Claims, 5 Drawing Sheets

TOMMY POWER OAR

BACKGROUND OF THE INVENTION

The typical canoe, rowboat, rowing skull or similar watercraft type oar that includes a shaft having a first end and a second end and an oar blade having a proximal end and a distal end and coupled to the second end of the shaft. These oars are made from many various types of materials and with many varying shape shafts and oar blade shapes and designs.

The typical canoe, rowboat, rowing skull or similar watercraft type oar blade is made with a flat face or slightly curved blade and of varying angles between the shaft and oar blade and may be made of a solid composition material or made up of multiple parts made of various composition materials and even natural wood.

Typically water flow that is generated by pulling the oar blade through the water travels to the edges of the oar blade and is lost energy that could otherwise be used for a greater purpose to help propel the watercraft forward or control the watercraft when going with the water current.

There have been many designs over the years to improve the typical canoe, rowboat, rowing skull or similar watercraft type oar, but none have attempted to use the force of the water pressure generated from pulling an oar through the water as this invention attempts to do.

This invention offers a means of using or harnessing the kinetic energy used to pull the oar blade through the water in order to gain force and also to reduce energy required to propel or navigate the watercraft forward and or to control the motion or direction of the watercraft.

By means of installing a multi-blade propeller or multiple propellers and cone like orifices on the canoe, rowboat, rowing skull or similar flat blade a means is then derived to control and harness the kinetic energy generated by pulling the canoe, rowboat, rowing skull or similar watercraft oar through the water.

This device offers a means that requires less energy to operate a canoe, rowboat, rowing skull or similar watercraft. This style oar also gives the rower more control over the watercraft he is maneuvering through the water.

SUMMARY OF THE INVENTION

This invention of a canoe, rowboat, rowing skull or similar watercraft oar device is an attempt to harness the kinetic energy generated while pulling a canoe, rowboat, rowing skull or similar watercraft oar blade device through the water. This invention comprises a shaft having a first end and a second end and an oar blade having a proximal end and a distal end and coupled to the second end of the shaft. The oar blade of this invention is equipped with a multi-blade propeller or multiple multi-blade propellers and can also be equipped with cone shape orifices or any combination of the two.

The use of the multi-blade propeller or multiple multi-blade propellers and cone shaped orifices are to capture the kinetic energy generated while pulling a canoe, rowboat, rowing skull or similar watercraft oar device through the water. The force or energy generated is transferred to the propeller blades and the water forced through the cone shaped orifices help propel the watercraft forward with less effort than a plain flat, curved or other type design surface oar blade.

The canoe, rowboat, rowing skull or similar watercraft oar device can be reversed 180 degrees so as to be used when the watercraft is going with the current to affect the watercraft to have more controlled movement and used as a control mechanism to help steer the watercraft due to the thrust of the multi-blade propeller or propellers and the water force generated from the cone shaped orifice devices.

BRIEF DESCRIPTION OF THE DRAWINGS

The attached drawings included in this presentation are to help further describe the embodiment of this invention. It is hoped the drawings will illustrate the heart of the invention and even go a step further in addressing the advantages of having a canoe, rowboat, rowing skull or similar watercraft oar with a multi-blade propeller or multi-blade propellers and orifices made into the oar blade.

DETAILED DESCRIPTION OF THE PREFERRED EMBODIMENTS

Figure 1:
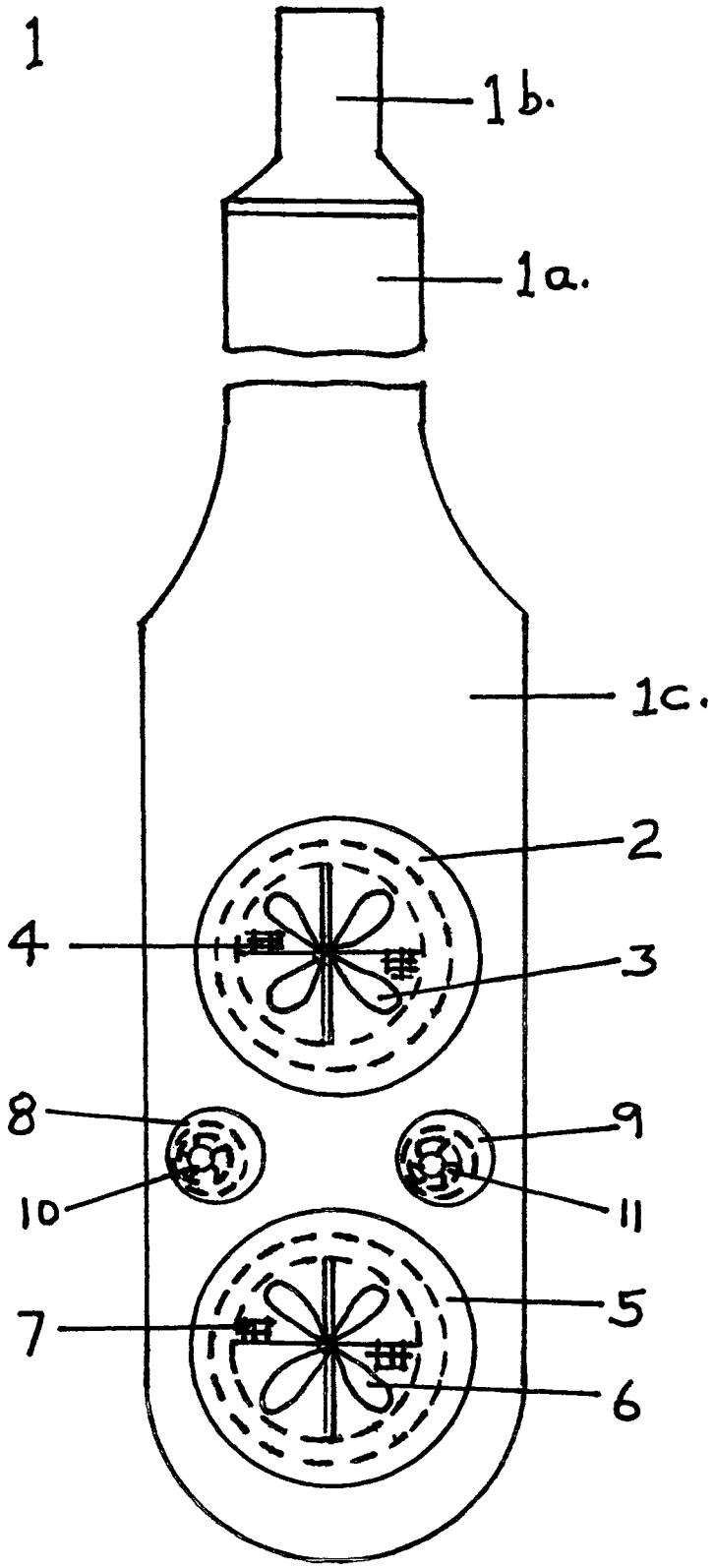
FIG. 1 illustrates a front perspective view of the canoe, rowboat, rowing skull or similar watercraft oar blade device with two propeller housing assemblies with multi-blade propellers as well as two orifice housings with the center rotating cone shape designed with inner ribs and grooves.

The following detailed description is not limited or intended to be limited to the following preferred embodiment description or illustration. Although every effort has been made to describe the particular embodiments, one skilled in the art may recognize certain changes that can be made in design or shape that may still be in the scope and spirit of the invention as declared in the claims for this invention.

The embodiments listed are intended to be illustrative and should not be deemed limited in their scope. The embodiments are not and should not be deemed to be totally exclusive in their depiction, furthermore, the components that make up this present invention can be used in various combinations and relationships to one another.

The process of making or manufacturing the Tommy Power Oar can be conducted either by using various power tools or can be completely hand made by a skilled craftsman. The handle, shaft and oar blade components of this invention can be comprised of natural components such as cypress wood and various other natural woods or a combination of manmade materials. The orifice housing and inner rotating cone shape with raised ribs and groove components as well as the multi-blade propeller housing with the multi-blade propeller would more than likely be made using high impact plastics or resins using an ejection-mold process. All of the components used in making this oar device should be water proof and extremely sturdy for use in all types of outdoor elements.

Please note, in respect to the attached description, it is noted that the size, shape and dimensional relationship between the various components of this invention can vary. Also, consideration for the types of material in the construction of the various components can vary and all equivalent relationships as illustrated in the drawings and described in the text are intended to encompass the embodiment of this invention.

Please note, that one skilled in the art may recognize possible modifications of the various components and embodiments of this present invention, however, the scope and spirit of this present invention is defined in the claims of this present invention.

FIG. 1 refers to an overall front view of the canoe, rowboat, rowing skull or similar watercraft oar rowing device. 1*a* refers to the oar rowing device shaft and 1*b* refers to the oar rowing device handle. Both of these may be of varying sizes and shapes and made of various material and material compositions, but intended to carry out the scope and idea of the oar rowing device. 1*c* refers to the oar blade that can also be made in various sizes and shapes and made of various material and material compositions to facilitate this invention. The fixed propeller housings 2 and 5 are designed to allow the inner multi-blade propellers 3 and 6 to rotate while having a swiveling action. The capability of having the multi-blade propeller 3 and 6 to swivel facilitates the relationship of the multi-blade propeller to be more in alignment with the water driving it from the pulling of the oar device through the water. The lattice type guards 4 and 7 allow the multi-blade propellers to be protected and are located on both sides of the oar blade device. This lattice type guards 4 and 7 are designed so as not to restrict the water driving the multi-blade propellers.

This also protects the operator of the oar device from the rotating multi-blade propellers. The fixed orifice device housings 8 and 9 are also designed to allow the rotation and swiveling action of the center cone shape orifice devices with raised ribs and grooves 10 and 11. The larger opening or entrance orifice of the fixed orifice device is on the leeward (or far side) side of the oar blade device. The smaller opening or discharge orifice is on the opposite side of the oar blade, or on the rower's side of the pulling stroke. This creates water force through the cone shaped orifice with the inner ribs and grooves through the kinetic energy of pulling the oar device through the water. These center orifice devices 10 and 11 are designed with a center rotating cone shape design with inner ribs and grooves allowing the cone shape inner device to rotate while having the capability of swiveling. The swiveling action of the cone shape inner device allows the center cone shaped orifice device to be more in alignment with the water driving it from the pulling of the oar device through the water. The center rotating cone shape device with the inner ribs and groves generates increased water pressure as the oar device is pulled through the water. This helps to reduce the effort of pulling the oar device through the water.

Figure 2:
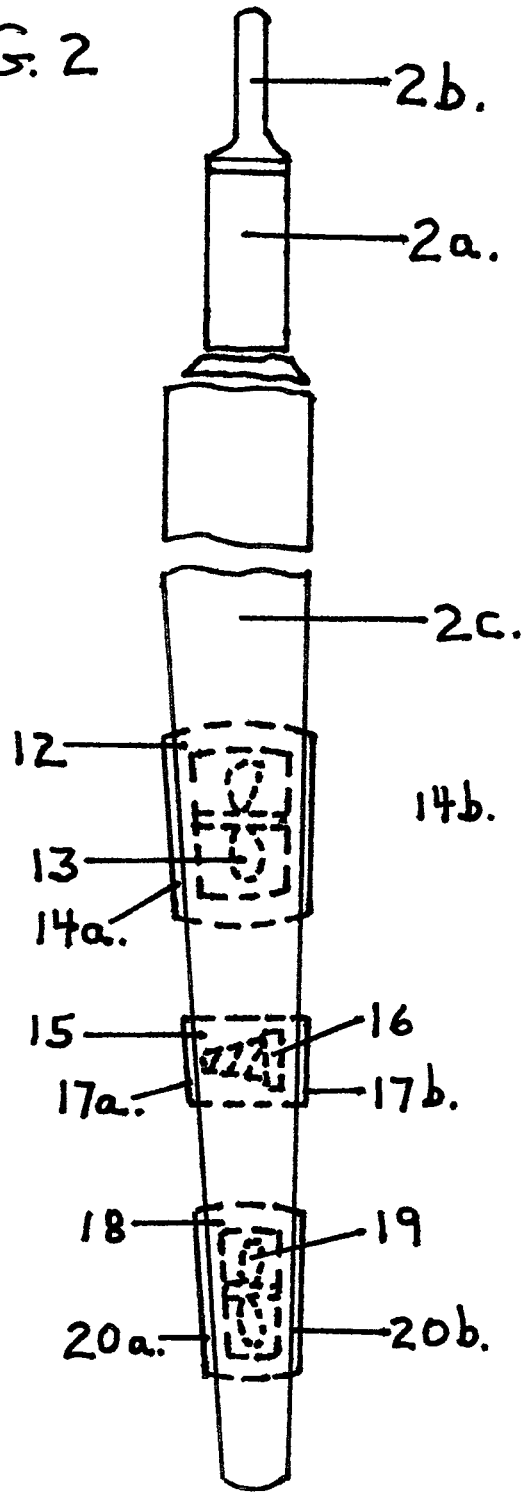
FIG. 2 illustrates an expanded side view of the canoe, rowboat, rowing skull or similar watercraft oar blade device with two propeller housings with multi-blade propellers as well as a orifice housing with the center rotating cone shaped designed with inner ribs and grooves.

FIG. 2 refers to an overall side view of the canoe, rowboat, rowing skull or similar watercraft oar device. 2*a* refers to the oar device shaft and 2*b* refers to the oar device handle. Both of these may be of varying sizes and shapes and made of various material and material compositions, but intended to carry out the scope and idea of the oar device. 2*c* refers to the oar blade that can also be made of various sizes and shapes and made of various material and material compositions to facilitate this invention. The fixed housing for the multi-blade propellers 12 and 18 are designed to allow the rotation and swiveling action of the inner multi-blade propellers 13 and 19. The lattice type guard 14*a*, 14*b*, 20*a* and 20*b* allows the propeller to be protected and does not restrict the water driving the multi-blade propellers 13 and 19. This also protects the operator of the oar device.

The fixed orifice device housing 15 is designed to allow the swiveling action of the inner orifice device 16 with the center rotating cone shape that has inner ribs and grooves. (Please note, one of the orifices on FIG. 2 are intentionally not shown for clarity.) The lattice type guards, 17*a* and 17*b* are shown on both sides of the oar blade device protecting the orifice device housing.

Figure 3:
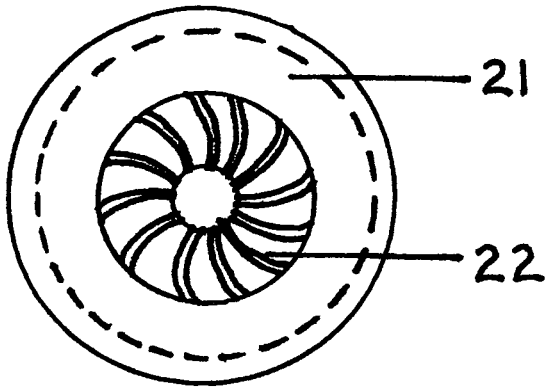
FIG. 3 illustrated an expanded front view of the orifice device housing with the center rotating cone shape design with inner ribs and grooves depicting the swiveling capability of the center rotating cone shape design with inner ribs and grooves.

FIG. 3 refers to an overall enlarged front view of the fixed orifice device housing. The fixed orifice device housing 21 is designed to allow the center rotating cone shape device 22 with raised ribs and grooves to have a swiveling capability. (The lattice type fixed orifice device lattice guards that are required on both sides of the oar blade are intentionally left off for clarity.)

Figure 4:
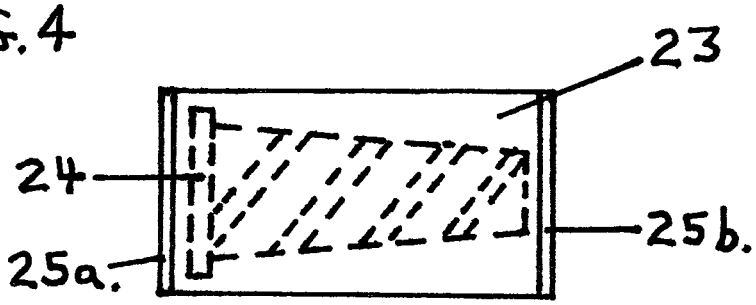
FIG. 4 illustrates an expanded side view of the orifice device housing with the center rotating cone shape design with inner ribs and grooves depicting the swiveling capability of the center rotating cone shape design with inner ribs and grooves.

FIG. 4 refers to an overall enlarged side view of the fixed orifice device housing with the center rotating cone shape device with raised ribs and grooves. The fixed orifice device housing 23 is designed to allow the rotating inner cone shape inner device 24 with raised ribs and grooves to also have a rotation and swiveling capability. The lattice type fixed orifice device guards are shown as 25*a* and 25*b* protecting the orifice device.

Figure 5:
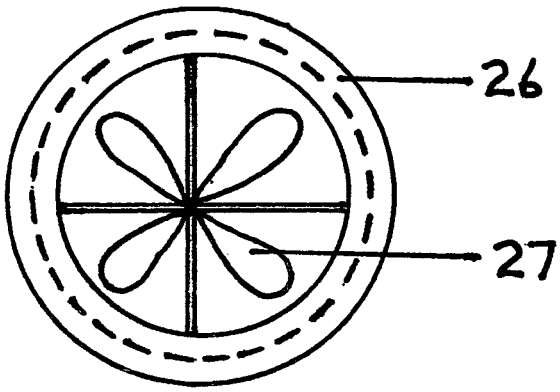
FIG. 5. Illustrates an expanded front view of the multi-blade propeller housing with the multi-blade propeller.

FIG. 5 refers to the overall enlarged front view of the propeller housing with the inner multi-blade propeller. The multi-blade propeller housing 26 is designed to allow the rotation and swiveling action of the multi-blade propeller 27. (The lattice type multi-blade propeller guards that are required on both sides of the oar blade are intentionally not shown for clarity.)

Figure 6:
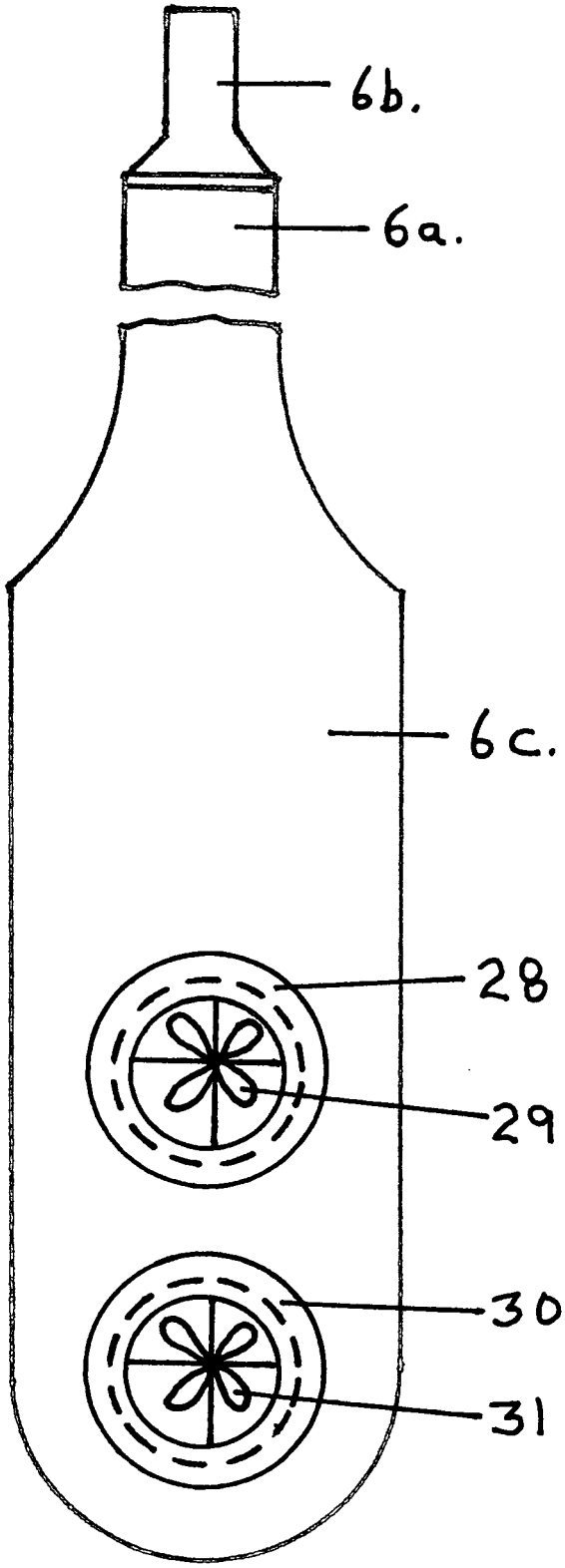
FIG. 6 illustrates a front view of the canoe, rowboat, rowing skull or similar watercraft oar blade device with two propeller housing assemblies with multi-blade propellers.

FIG. 6 refers to an overall front view of the canoe, rowboat, rowing skull or similar watercraft oar device having two multi-blades without any orifice devices. Reference 6*b* refers to the oar device handle and 6*a* refers to the oar device shaft. Both of these may be of varying sizes and shapes and made of various material and material compositions, but intended to carry out the scope and idea of the oar device. 6*c* refers to the oar blade device that can also be made of various sizes and shapes and made of various material and material compositions, but intended to carry out the scope and idea of the oar device. The fixed housings for the multi-blade propellers 28 and 30 are designed to allow the rotation and swiveling action of the inner multi-blade propellers 29 and 31. (The lattice type multi-blade propeller guards that are required on both sides of the oar blade are intentionally not shown for clarity.)

Figure 7:
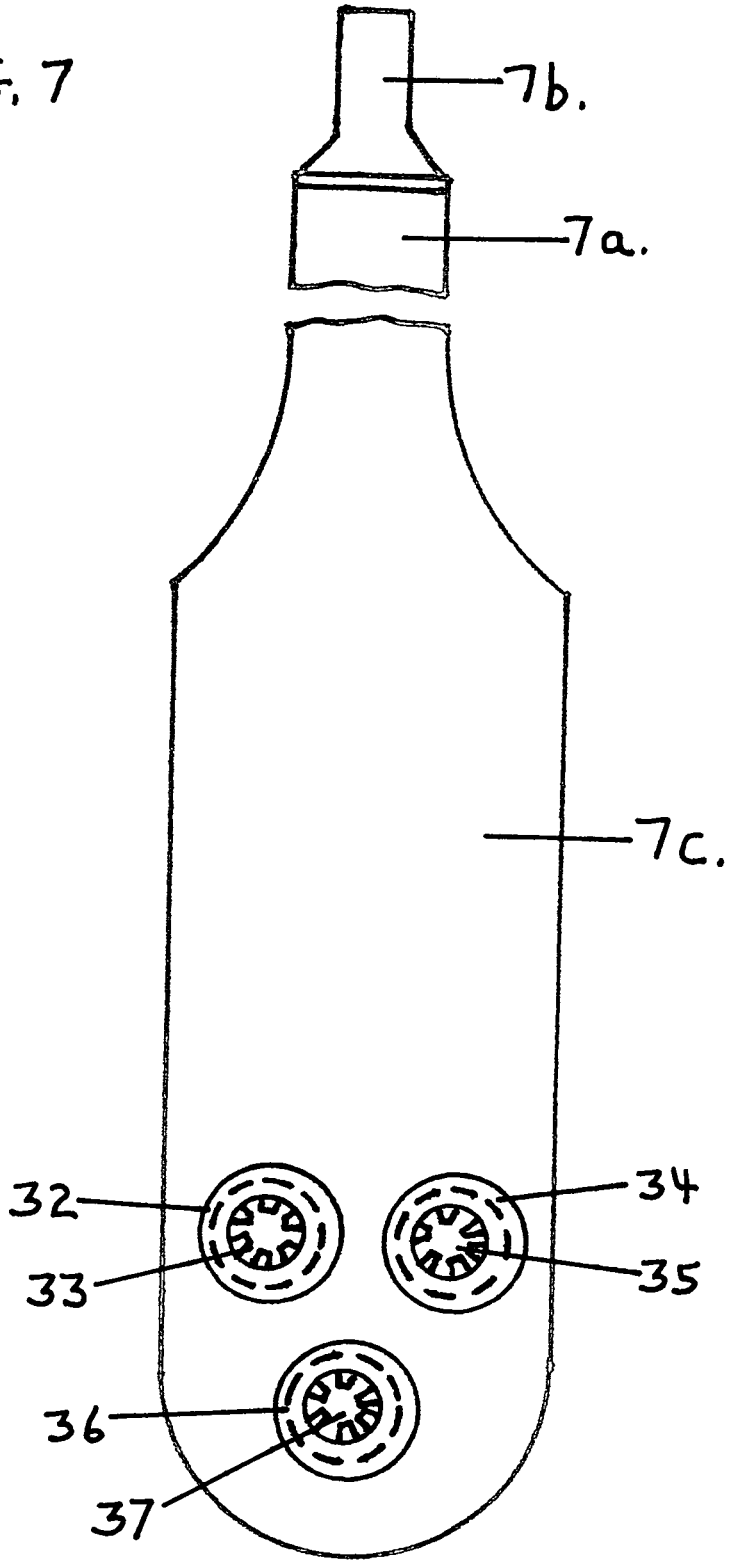
FIG. 7 illustrates a front view of the canoe, rowboat, rowing skull or similar watercraft oar blade device with three cone shaped orifice devices with the center rotating cone shape design with inner ribs and grooves.

FIG. 7 refers to an overall front view of the canoe, rowboat, rowing skull or similar watercraft oar device with three orifice devices without any multi-blade propellers. Reference 7*b* refers to the oar device handle and 7*a* refers to the oar device shaft. Both of these may be of varying sizes and shapes and made of various material and material compositions, but intended to carry out the scope and idea of the oar device. 7*c* refers to the oar blade device that can also be made of various sizes and shapes and made of various material and material compositions, but intended to carry out the scope and idea of the oar device. The fixed orifice housing 32, 34 and 36 are designed to allow the rotation and swiveling action of the inner cone shape device with raised ribs and grooves 33, 35 and 76. (The lattice type orifice device guards that are required on both sides of the oar blade are intentionally not shown for clarity.)

I claim:

1. An oar rowing device for maneuvering or powering a watercraft comprising:

a shaft having a first end and a second end;

an oar rowing blade having a proximal end and a distal end and coupled to the second end of the shaft; the oar rowing blade comprising;

one or more multi-blade propeller housings mounted therein, each having a multi-blade propeller; each propeller housing being open on both sides of the oar rowing blade;

one or more orifice device housings through the oar rowing blade;

a device rotatably mounted within each orifice device housing, each device comprising a cone shaped through hole defining large and small openings, inner ribs and grooves; the large opening of the cone shaped device being on the face side of the oar rowing blade and the small opening, or discharge side, is on the opposite side of the oar rowing blade device;

wherein a pulling stroke of the oar rowing device forces water through the propeller and orifice device housings to rotate the respective propeller or device therein, thus increasing water pressure-through each propeller or device to reduce the physical effort of pulling the oar rowing device through the water.

2. The oar rowing device of claim 1 where each multi-blade propeller is oriented so as the thrust is away from the pulling stroke of the oar rowing blade such that rushing water generated by the pulling stroke forces each multi-blade propeller and device to rotate forcing water in the direction of the pulling stroke or in the direction of the oar movement to help propel the watercraft forward.

3. The oar rowing device of claim 1 where each multi-blade propeller is designed to swivel within each multi-blade housing so as to keep each multi-blade propeller more in line with a pulling force of water generating the propeller blade rotation.

4. The oar rowing device of claim 1 where each multi-blade propeller is protected by a lattice guard on both sides of the oar rowing blade.

5. The oar rowing device of claim 1 where the rotating cone shaped device swivels relative to the blade so as to keep water force generated by the pulling stroke of the oar in line with a pulling force of the water.

6. The oar rowing device of claim 1 where each oar rowing device can be used in a reverse fashion by rotating the oar blade up to 180 degrees so as to be used when navigating a watercraft with a water current in order to help stabilize the watercraft by using the force of the current against the blade to aid in controlling the watercraft.

* * * * *